United States Patent [19]

Thomas

[11] 4,104,885

[45] Aug. 8, 1978

[54] TUNNEL LINING

[75] Inventor: Norman Stanley Thomas, Stone, England

[73] Assignee: Fairclough Construction Group Limited, London, England

[21] Appl. No.: 806,874

[22] Filed: Jun. 15, 1977

[30] Foreign Application Priority Data

Jun. 21, 1976 [GB] United Kingdom ..... 25652/76
Aug. 13, 1976 [GB] United Kingdom ..... 33798/76

[51] Int. Cl.[2] ..... E21D 11/08
[52] U.S. Cl. ..... 61/45 R; 61/84; 52/89; 52/585
[58] Field of Search ..... 61/45 R, 84; 52/585, 52/89

[56] References Cited

U.S. PATENT DOCUMENTS

| | | | |
|---|---|---|---|
| 640,473 | 1/1900 | Küpper | 52/585 |
| 1,381,119 | 6/1921 | Hastings | 61/45 R |
| 2,328,823 | 9/1943 | MacKenzie | 52/585 |
| 3,786,611 | 1/1974 | Brown et al. | 52/585 |

*Primary Examiner*—Jacob Shapiro
*Attorney, Agent, or Firm*—Karl W. Flocks

[57] ABSTRACT

A concrete segment for a tunnel lining, having an end connectable to an end of another identical segment abutting thereagainst by means of connecting dowels insertable from an end of the segment remote from the abutting end thereof or from one side of the segment into two channels within the segments, each channel extending through an end of the segment and into the end of said abutting segment, the channels being disposed at an angle to one another whereby the segments are held together when the dowels are in position.

18 Claims, 23 Drawing Figures

TUNNEL LINING

This invention relates to the connecting together of concrete segments for tunnel linings, and annuli assembled from such segments, especially for tunnels of the smooth bore type.

The smooth bore type of segments for tunnel linings have an advantage over the bolted/recessed type of segments in that tunnels lined with them and intended for the flow of liquids do not require an additional lining to be cast in situ after the segments have been assembled. At present two main types of smooth bore segment are used. In tunnels driven in consistently good ground such as London clay block type segments can be assembled against the excavated ground behind a tunnelling shield and can then be expanded to form a tight circle with no annular space between the segments and the ground clay. In tunnels driven in less consistently good ground smooth bore segments are used which are built away from the encircling ground, either with or without a shield, and the annular space between the segments and the ground is then grouted up. Until grouting has taken place and the grout has set the segments require internal support. Conventionally this support consists of temporary struts erected within the segments which support is time consuming to erect and remove and restricting as to movement within the tunnel.

The present invention provides a concrete segment for a tunnel lining having an end connectable to an end of another identical, segment abutting thereagainst by means of connecting dowels insertable from an end of the segment remote from the abutting end thereof or from one side of the segment into two channels within the segment, each channel extending through an end of the segment and into the end of said abutting segment, the channels being disposed at an angle to one another whereby the segments are held together when the dowels are in position.

In a further aspect the invention provides an annulus for a tunnel lining comprising a plurality of such concrete segments joined end-to-end.

The invention also provides a tunnel lining comprising a plurality of such annuli assembled side-by-side.

In one embodiment of the invention the segment is formed at each end with a pair of channel portions disposed at an angle to one another within the segment and registerable with corresponding channel portions in the end of an abutting segment to form a pair of channels, a channel portion at each end of the segment opening into one of the sides thereof. The dowels may thus be inserted from one side of the annulus, which will generally be the forward edge of the annulus as a series of annuli are assembled side-by-side, one after another.

In another embodiment the segment is formed with a pair of channel portions disposed at an angle to one another within the segment and extending from a first end to a second end of the segment, said channel portions being registerable at the first end with corresponding channel portions in the second end of an abutting, identical segment. In this embodiment the dowels may be inserted from the free end of a segment as the annulus is built up from the segments.

The segment is preferably shaped such that one end has a projecting tongue between planar faces extending to the sides of the segment, the tip of the tongue being offset towards one side of the segment, and the other end of the segment being of complementary shape to abut the end of an adjacent segment. This arrangement gives an annulus of particularly high strength. The sides of each segment are preferably provided with means whereby successive annuli may be fastened together, for example a step joint or a horizontal dowel joint. The annuli may also be connected together by arcuate connecting members passing through curved channels in the sides of the segments, each channel opening at one end on a side of the segment and at its other end into a recess in the internal surface of the segment through which the connecting member can be inserted; the recess may be filled after assembly to provide a smooth inner surface. The segments may also be formed with holes extending between their internal and external surfaces to allow injection of material to fill the annular space between the lining and the ground, and they may be made with peripheral recesses so that the assembled tunnel lining may be caulked to ensure water-tightness.

The annulus may include a key segment positioned between a pair of adjacent segments. In one embodiment the key segment is provided with channel portions registerable at either end with channel portions at the abutting ends of the adjacent segments to form channels disposed at an angle to one another so that the assembly of the key segment and the two adjacent segments can be held together by insertion of connecting dowels in the channels. The key segment channel portions may open into one of the sides of the segment, to allow insertion of the dowels from the advancing edge of a tunnel lining formed of the annuli, or they may open into the interior surface of the segment to allow insertion from within the annulus.

In another arrangement the key segment and the adjacent segments are formed with radial end faces, the key segment faces each having a circumferentially outwardly projecting apertured bar and the faces of the adjacent segments are each formed with a slot to receive the associated bar, the adjacent segments each being formed with an axial aperture to receive a locking dowel passed therethrough and through the aperture in the corresponding bar.

In yet another arrangement the key segment has at least one key at each end provided with a hole and the abutting ends of the adjacent key segments have corresponding keys with holes to align with the holes of the key segment lugs and the key segment is locked in place by dowels passing through the holes. A recess in the inner surface of the key segment may be provided to allow insertion of the dowels from within the annulus and the recess may then be refilled to provide a smooth inner surface.

Various embodiments of a tunnel lining, annulus and segments making up such an annulus will now be described by way of example only with reference to the accompanying drawings, in which.

Figure 1:
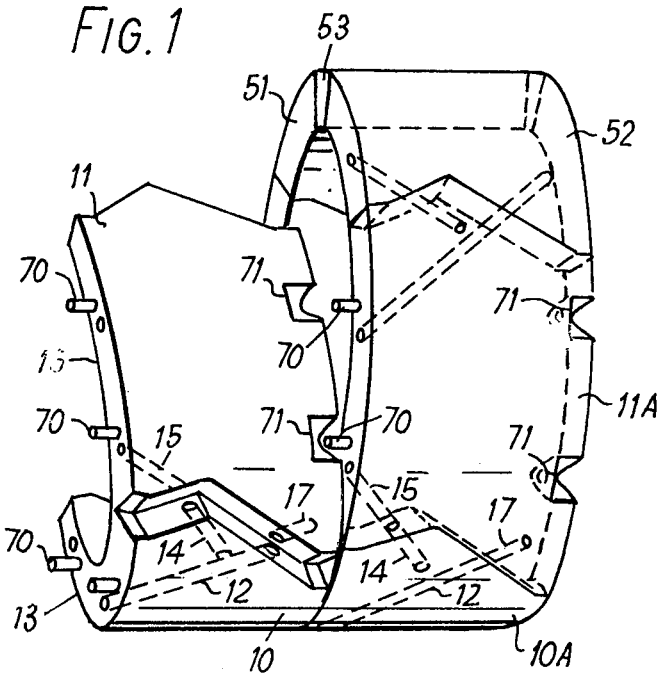
FIG. 1 is an external view of a part of a tunnel lining in the course of construction showing the most recently assembled annulus and two segments being assembled to form part of the next annulus.

Referring to FIG. 1, an annulus for a tunnel lining is made up of a plurality of segments which are precast concrete blocks of densities of from 90 to 160 lbs/cu.ft. End portions of a pair of adjacent segments 10 and 11 abut one another, and end portions of a pair of segments 10A and 11A in an adjacent annulus are also shown. The segment 10 is formed with an internal channel portion 12 extending from its leading side 13 (i.e. its side remote from the assembled portion of the tunnel lining) to its end and with a blind channel portion 14 formed in its end. The abutting segment 11 is formed with a channel portion 15 extending from its leading side 16 to its end and with a blind channel portion 17 also formed in its end. The channel portions 12 and 14 within the segment 10 register with the channel portions 17 and 15 within the segment 11 to provide a pair of channels disposed at an angle to one another. As shown in FIG. 1 the channels are at about 90° to one another, but an angle from about 40° to 90° will generally be satisfactory. Each channel portion 12, 14, 15 and 17 is disposed at about 45° with respect to the leading edge 13, 16 of its respective segment. Rigid metal connecting dowels 18 and 19 (FIG. 3) are inserted into the channels by means of a jack and hold the segments 10 and 11 together.

Figure 2:
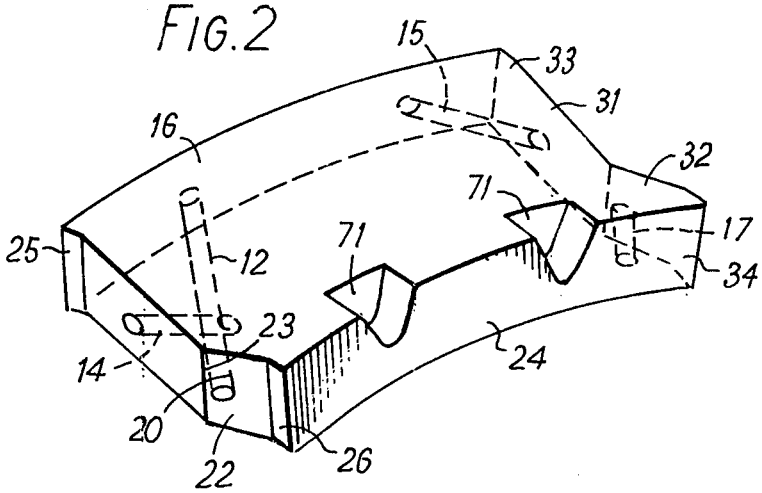
FIG. 2 is a perspective view of a segment to be incorporated into the annulus shown in FIG. 1 in a position remote from the key member.
Figure 3:
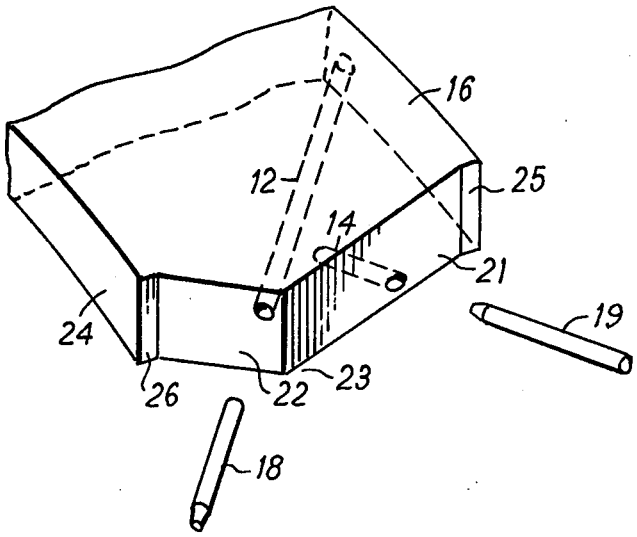
FIG. 3 is a perspective view of an end portion of the segment shown in FIG. 2.
Figure 4:
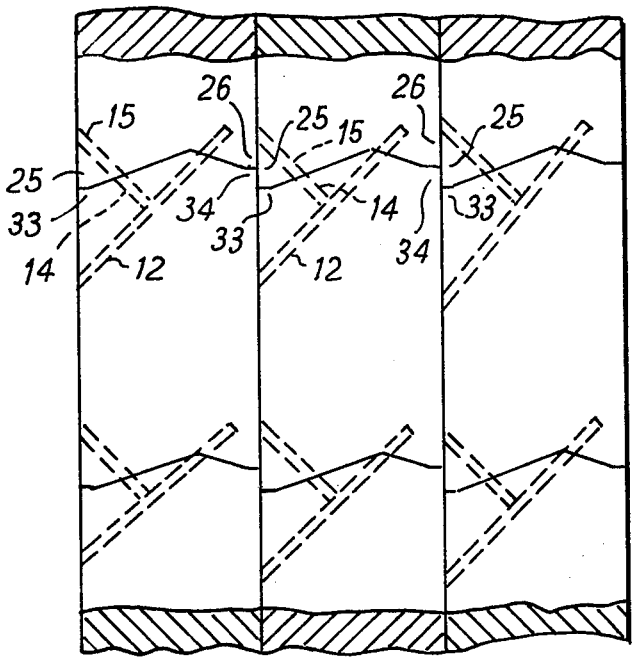
FIG. 4 is a view from the inside face of part of an assembled tunnel lining.

The preferred shape for the ends of the segments (other than those adjacent to a keying member) is shown in FIGS. 2 and 3. A central portion of one end of the segment is formed with a projecting tongue 20 bounded by outwardly disposed plane faces 21 and 22, the tip 23 of the tongue being offset towards the trailing side 24 of the segment. One channel portion 12 passes from the leading side 16 through the trailing face 22 and the other channel portion 14 is formed in the leading face 21. The tongue is bounded on either side by end faces 25 and 26 formed in spaced parallel planes perpendicular to the sides of the segment. The other end of the segment is shaped to receive the tongue 20 of an adjacent segment and is formed with a recess bounded by plane faces 31 and 32. The channel portion 15 extends between the leading side 16 of the segment and the leading face 31. The channel portion 17 extends behind the trailing face 32. The recess is bounded by end faces 33 and 34 formed in spaced parallel planes and corresponding to the end faces 25 and 26, so that the point of contact between the leading edge and faces 25, 33 of a pair of segments in one annulus is in staggered relationship to the point of contact between trailing edge end faces 26, 34 of a corresponding pair of segments in an adjacent annulus (FIG. 4). The advantage of using the end construction shown in FIGS. 1–3 is that the resulting joint between the end sections is of higher strength than can be obtained when many other possible end constructions are used.

Figure 5:
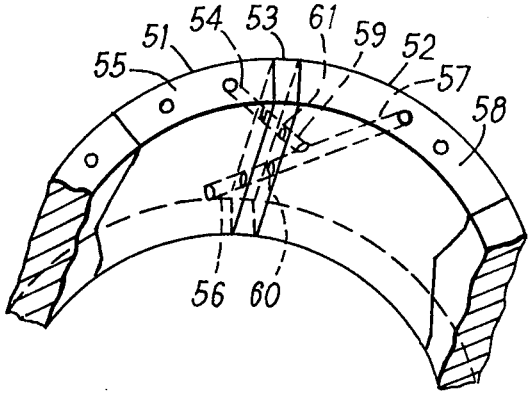
FIG. 5 is a perspective view from below of a key member and two adjacent segments.

The arrangement at the key segment is shown in FIG. 5. As appears from the Figure, the segments 51 and 52 adjacent the key segment 53 have tongues and recesses of the kind described above formed at their ends remote from the key segment. However, their ends abutting the key segment 52 are planar. The segment 51 is formed with a channel portion 54 extending from its leading side 55 to its planar end and with a blind channel portion 56 in its planar end. The segment 52 is similarly formed with a channel portion 57 extending from its leading side 58 to its planar end and with a blind channel portion 59 in its planar end. The key segment 53 is formed with channel portions 60, 61 such that in the assembled annulus the channel portions 54, 61 and 59 and the channel portions 56, 60 and 57 register to provide a pair of channels disposed at an angle to one another. Connecting dowels can be inserted into the channels to hold the segments 51 and 52 and the key segment 53 together.

Figure 6:
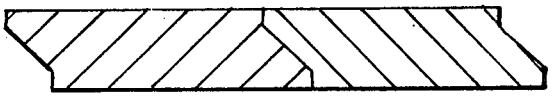
FIG. 6 is a sectional view of a pair of segments in adjacent annuli according to another embodiment of the invention.
Figure 7:
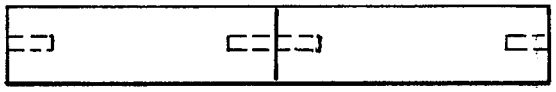
FIG. 7 is a sectional view of a pair of segments in adjacent annuli according to a further embodiment of the invention.
Figure 8:
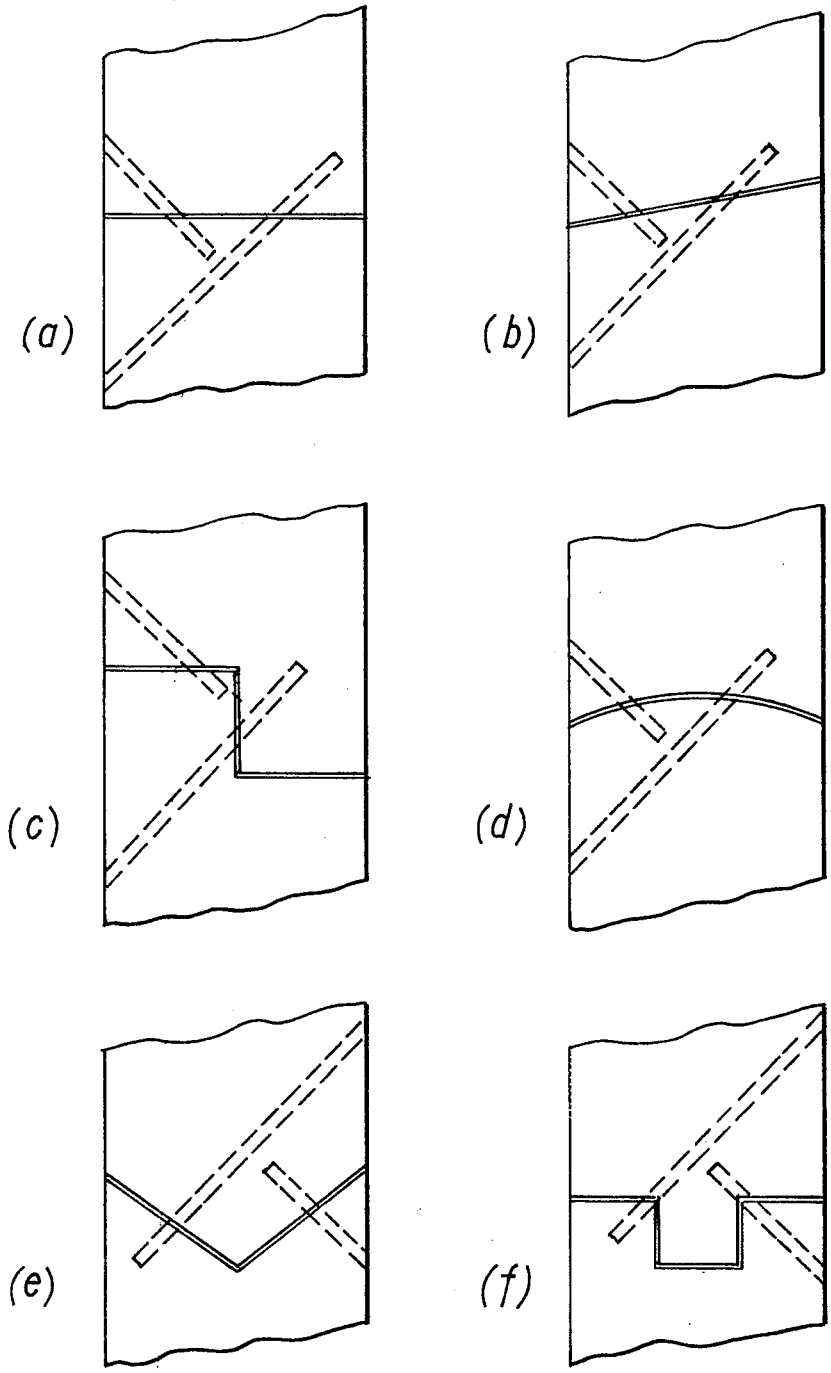
FIGS. 8*a* and 8*f* show junctions between adjacent segments according to yet further embodiments of the invention.

Referring to FIG. 1 which shows part of a tunnel lining, an annulus is assembled by abutting the side edges of segments at the lower portion thereof and driving the connecting dowels into the channels within the segments. Further segments are added until the annulus is nearly complete, after which the planar end segments 51 and 52 and the key segment 53 are inserted and fixed in place. The adjacent annuli can be fastened together by means of a step joint (FIG. 6) or by means of horizontal dowels (FIG. 7). The connections between successive annuli are preferably spaced equi-angularly from one another so that successive annuli can be rotated relative to one another and can still receive the connections from the preceding and successive annuli. The key segment used need not be at the top of the annulus but may alternately be rotated clockwise and anti-clockwise relative to the top of the annulus. One possible method of joining the annuli together is shown in FIGS. 1 and 2. Connecting dowels 70 are provided at equi-angular positions around the leading edge of the annulus. The dowels 70 may be cast into the segments at the time of manufacture or they may be inserted into channels provided in the leading edge at the same time that the connecting dowels are inserted. The dowels are received in corresponding recesses 71 formed in the external surface of the trailing edge of the next annulus. Grouting material is then injected under pressure through radially extending passages (not shown) in the segments to fill the annular space between the lining and the ground, and the grouting also fills the recesses 71 if present. The edges of the internal surface of the segments are constructed so as to form small recesses (not shown) in and between adjacent annuli and caulking is inserted into these recesses to ensure water-tightness of the tunnel lining.

The construction depicted has the advantage that finishing of the internal surface is easy and does not involve the use of cement. The annulus when assembled together is self-supporting and does not require the temporary or permanent support systems in conventional use with smooth segments for tunnel linings.

Figure 9:
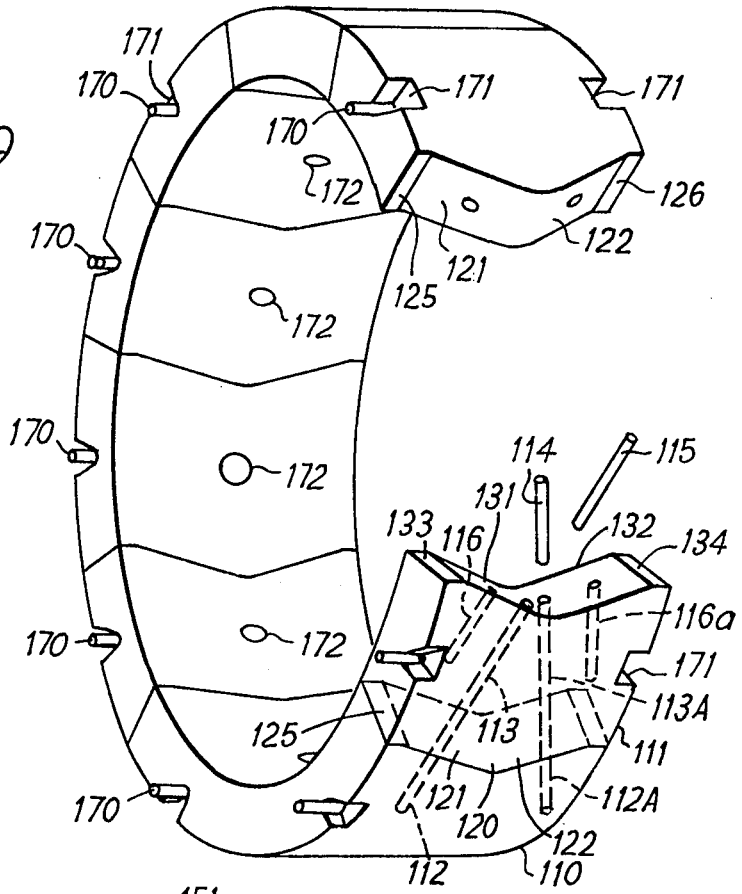
FIG. 9 is an external perspective view from the front and off to one side of an annulus for a tunnel lining in the course of assembly according to yet another embodiment of the invention.

In the embodiment shown in FIG. 9, an annulus for a tunnel lining is made up of a plurality of segments which are pre-cast concrete blocks of densities from 90 to 160 lbs/cu ft. End portions of a pair of adjacent segments 110 and 111 abut one another. The segment 110 is formed with blind internal channel portions 112 and 112*a* extending from its end in directions parallel to the general direction of the internal surfaces of the segment. The abutting segment 111 is formed with internal channel portions 113 and 113*a* extending from the end edge remote from the segment 110 to the end edge abutting the segment 110. The channel portions 112 and 113 and the channel portions 112*a* and 113*a* in the pair of abutting segments register to provide a pair of channels disposed at an angle to one another such that rigid metal connecting dowels 114 and 115 can be inserted into the channels by means of a hand or pneumatic hammer or a jack to hold the segments together. In addition to the channels 113, 113*a*, the segment 111 is formed with blind channels 116, 116*a* in its end edge remote from the segment 110, the channels 116, 116*a* of the segment 111 being similar to the channels 112, 112*a* of the segment 110.

The preferred shape for the ends of the segments (other than those adjacent a keying member) is as shown in FIG. 9 in relation to the segment 111. One end of the segment is formed with a projecting tongue bounded by outwardly disposed plane faces 121 and 122 and on either side by end faces 125 and 126 formed in planes perpendicular to the sides of the segment. The other end of the segment 111 is shaped to receive the tongue of an adjacent similar segment and is formed with a recess bounded by plane faces 131 and 132 and on either side by end faces 133 and 134 formed in parallel planes and corresponding to the end faces 125 and 126. The advantage of using this kind of end construction is that the joint between the adjacent sections 110 and 111 is of higher strength than can be obtained when many other possible end constructions are used. In the construction shown the tongue is formed symmetrically but it may if desired be offset in the direction of the leading or of the trailing side of the segment.

Figure 10:
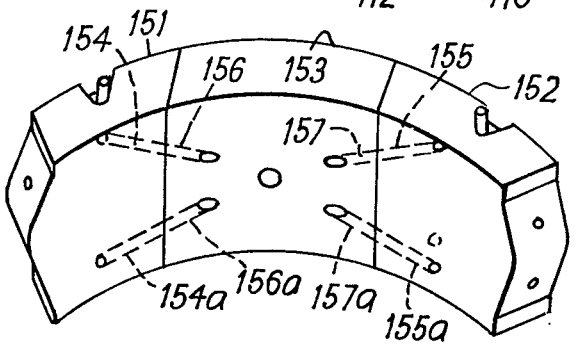
FIG. 10 is a perspective view from below showing a key segment and two adjacent segments which form part of the annulus shown in FIG. 9.

The arrangement at the key segment is shown in FIG. 10. As appears from the figure, the segments 151 and 152 adjacent the key segment 153 have tongues of the kind previously described formed at their ends remote from the key segment. However, their ends abutting the key segment 152 are planar. The segment 151 is formed with blind internal channel portions 154, 154*a* extending into its planar end edge and the segment 152 is formed with similar channel portions 155, 155*a*. The key segment is formed at its end edges with channel portions 156, 156*a* at one end registrable with the channel portions 154 and 154*a* and with channel portions 157, 157*a* at the other end registrable with the channel portions 155, 155*a* to provide at each end of the key segment a pair of channels disposed at an angle to one another. Each of the channels 156, 156*a*, 157, 157*a* extends from an end of the segment to the internal surface thereof. Rigid metal connecting dowels can be inserted from within the annulus into each pair of channels to hold the segments 151 and 152 to the key segment 153.

Figure 11:
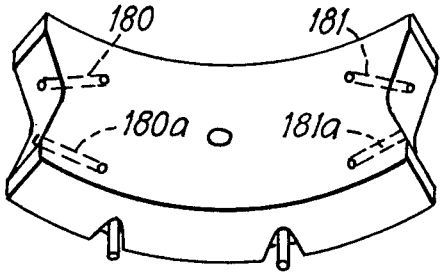
FIG. 11 is a perspective view of an invert segment which forms part of the annulus shown in FIG. 9.

FIG. 11 shows an invert segment for incorporation into the annulus. It extends over an arc length twice the length of an ordinary tunnel segment and is formed at each end with a recess dimensioned to receive a tongue on the end of an ordinary tunnel segment. Blind internal channel portions 180, 180*a* and 181, 181*a* are provided at the ends of the invert segment which register with the channel portions 113, 113*a* of an ordinary segment to allow the ordinary segment to be connected to the respective end of the invert segment.

The annulus can be assembled by placing the invert segment at the bottom thereof, abutting the ends of ordinary segments 110 against the ends of the invert segments and inserting connecting dowels into the channels within the segment to connect the ordinary segments to the invert segment, adding further segments until the annulus is nearly complete, after which the planar end segments 151 and 152 and the key segment 153 are inserted and fixed in place. The adjacent annuli can be fastened together by means of a step joint or by means of horizontal dowels. The connections between successive annuli can be spaced equi-angularly from one another in which case successive annuli can if desired be rotated relative to one another and can still receive the connections from the preceding and successive annuli. For example, the key segment used need not be at the top of the annulus but may alternately be rotated clockwise and anti-clockwise relative to the top of the annulus. However, with the construction shown in FIGS. 9 to 11 it is more usual that the adjacent annuli are not rotated relative to one another so that the invert segment is always positioned precisely at the bottom of the tunnel.

One possible method of joining the annuli together is shown in FIGS. 9 and 10. Connecting dowels 170 are provided at equi-angular positions around the leading edge of the annulus. The dowels 170 may be cast into the segments at the time of manufacture or they may be inserted into channels provided in the leading edge at the same time that the connecting dowels are inserted. The dowels are received in corresponding recesses 171 formed in the external surface of the trailing edge of the next annulus. As appears from the drawing the recesses 171 are advantageously provided on both the leading and trailing edges of the segment and behind each recess there is a hole extending into the segment for receiving a dowel 170. The advantage of this arrangement is that the annulus is symmetrical and either of its side edges can be used as the leading edge. Grouting material is injected under pressure through radially extending passages 172 in the segments to fill the annular space between the lining and the ground, and the grouting also fills the recesses 171 if present. The edges of the internal surface of the segments are constructed so as to form small recesses (not shown) in and between adjacent annuli and caulking is inserted into these recesses to ensure water-tightness of the tunnel lining.

The construction of this embodiment has the advantage that finishing of the internal surface is easy and does not involve the use of cement. The annulus when assembled together is self-supporting and does not require the temporary or permanent support systems in conventional use with smooth segments for tunnel linings. It is convenient for use either with or without a tunnelling shield.

Various modifications in all these embodiments can be made without departing from the invention. For example the number of segments and their internal diameter may be varied in accordance with the desired tunnel diameter.

Figure 12:
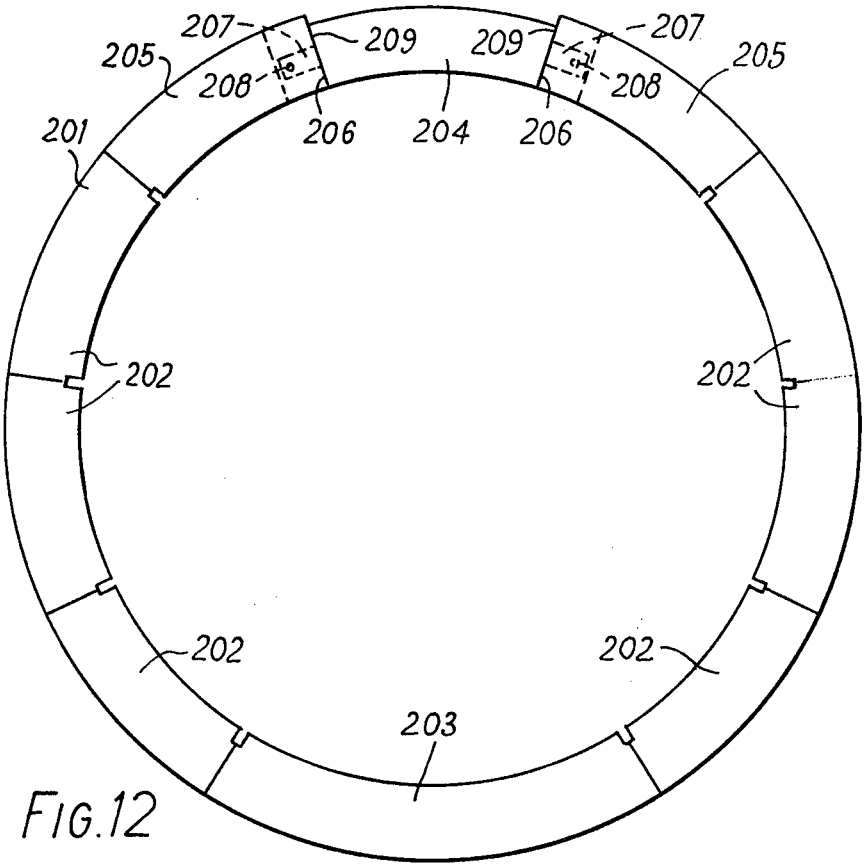
FIG. 12 is an axial view of an annulus according to yet another embodiment of the invention, using a different type of keying segment.

In the embodiment of FIG. 12, a concrete tunnel lining annulus 201 is made up from segments 202 and an invert segment 203 as in the embodiment of FIG. 9. The annulus has a keying segment 204 and adjoining segments 205. The keying segment 205 is formed with radial end faces 206 and circumferentially extending bars 207 formed with an aperture 208.

Figure 14:
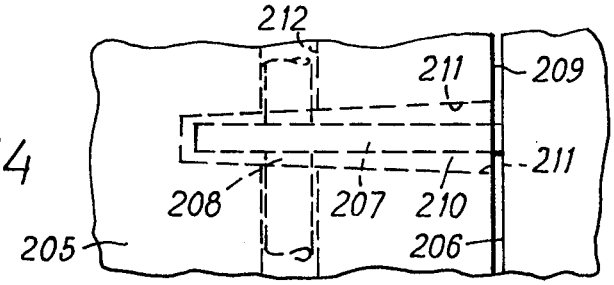
FIG. 14 is an enlarged detail showing assembly of the keying segment of FIG. 13.

Each of the adjoining segments 205 has its end face 209 nearest the keying segment disposed radially and, as shown best in FIG. 14, formed with a circumferential slot 210 with tapered walls 211. An aperture 212 is formed through each adjoining segment 205 to register with the aperture 208 in a bar 207 when the latter is fully home in the slot 210. A locking dowel 213 is passed through the aperture 212 to engage in the aperture 208 to lock the keying segment 204 with its adjoining segments 205. It will be understood that as the tunnel lining is being erected only the axial end face of the last erected annulus is accessible. Accordingly the dowels 213 must be driven back from beyond the newly erected annulus.

Figure 13:
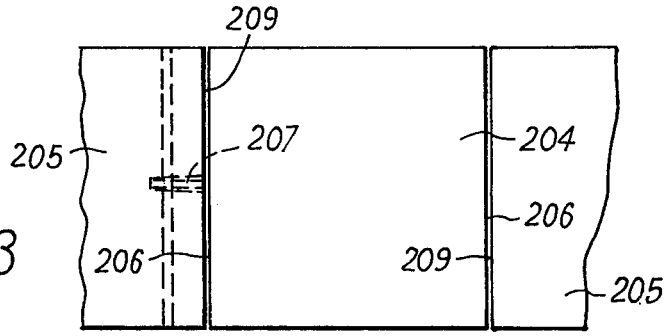
FIG. 13 is a view of a keying segment in the annulus of FIG. 12 from above.
Figure 15:
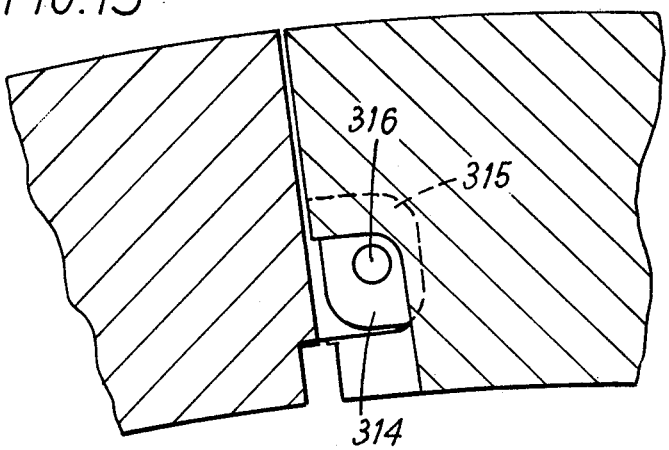
FIG. 15 is an axial view of a joint between a key segment and an adjacent segment according to the invention using a different type of key segment.
Figure 16:
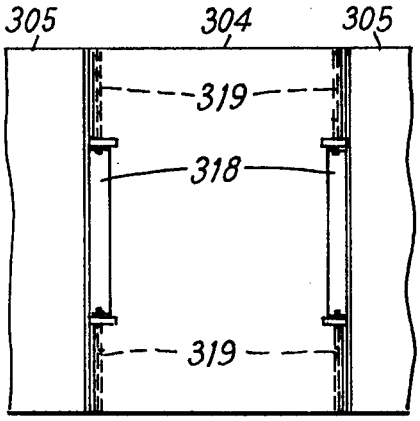
FIG. 16 is a view of the key segment of FIG. 15 between two adjacent segments using the joint shown in FIG. 15.
Figure 17:
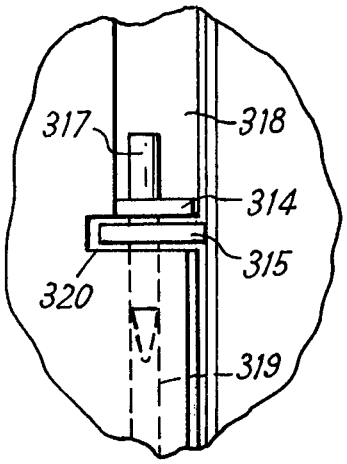
FIG. 17 shows part of FIG. 16 on an enlarged scale.

In the embodiment shown in FIGS. 15, 16 and 17 the annulus includes a key segment 304 and adjoining segments 305 with radial end faces 306 as in the embodiment of FIGS. 12, 13 and 14. In this case however each end of the key segment has cast into it a pair of steel lugs 314 and the adjacent faces of the adjoining segments have corresponding pairs of lugs 315. The lugs have holes 316 which are aligned when the annulus is assembled to receive steel dowels 317 to lock the key segment and adjoining segment together. As best seen in FIG. 16 the key segment is provided with recesses 318 opening into the interior of the annulus so that the dowels 317 may be inserted when the keying segment is in position. Clearance holes 319 are present in the key segment to receive the dowels.

In order to allow mounting of the key segment in place slots 320 are provided in the keying segments to accommodate the lugs 315.

When the rest of the annulus has been assembled the key section may be placed in position from within the annulus, the dowels 319 inserted from recesses 318 and the recesses may then be filled with a sand/cement compound or other material to provide a smooth interior surface.

Figure 18:
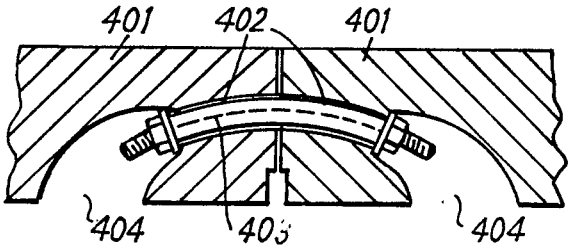
FIG. 18 is a section of two assembled adjacent annuli showing joining of adjacent segments according to yet another embodiment of the invention.

An alternative means of joining adjacent annuli is shown in FIG. 18. In this case the abutting segments of adjacent annuli 401 are provided with arcuate channels 402 terminating at the sides of the segments in openings which are aligned with one another to define an arcuate channel to receive an appropriately shaped connecting member 403. The other ends of the channels 402 terminate in recesses 404 in the internal wall of the respective segments. The recesses 404 are shaped to allow insertion of the rigid arcuate connecting member into the channel and in the embodiment shown are continuations of the channels 402 but have a larger width.

When the annuli have been joined together by the connecting members 403 the recesses 404 may be filled by means of a preformed concrete plug or by grouting to provide a smooth inner surface for the annuli.

In the embodiment shown in FIG. 18 the connecting member is an arcuate bolt threaded at each end to receive nuts clamping the annuli together. An arcuate bolt having a pre-formed head at one end and a nut at the other end may also be used. The bolt may be replaced by a post-terminal anchored steel tendon or by a tensioned steel strap.

I claim:

1. A concrete segment for an annulus of a tunnel lining, having an end connectable to an end of another, identical, segment of the annulus abutting thereagainst by means of connecting dowels insertable from an edge of the segment other than the abutting end thereof into at least two channels within the segments, each channel extending through an edge of the segment and in alignment with the end of and partially into said abutting segment, the channels being disposed at an angle to one another whereby the segments are held together when the dowels are in position.

2. A segment according to claim 1, formed at each end with a pair of channel portions disposed at an angle to one another within the segment and registerable with corresponding channel portions in the end of an abutting segment to form a pair of channels, a channel portion at each end of the segment opening into one of the sides thereof.

3. A segment according to claim 1, formed with a pair of channel portions disposed at an angle to one another within the segment and extending from a first end to a second end of the segment and said channel portions being registerable at the first end with corresponding channel portions in the second end of an abutting identical segment.

4. A segment according to claim 1, in which one end of the segment is shaped such that it has a projecting tongue between planar faces extending to the sides of the segment, the tip of the tongue being offset towards one side of the segment, and the other end of the segment being of complementary shape to said one end.

5. A segment according to claim 1, of which both sides are provided with holes to receive dowels to connect abutting sides of adjacent segments.

6. A segment according to claim 1, in which one side is provided with a step and the other side is of a shape complementary to said one side to provide a joint between abutting sides of adjacent segments.

7. A segment according to claim 1, provided with inwardly curving arcuate channels, each arcuate channel opening at one end on a side of the segment and being allignable with a corresponding opening of another arcuate channel within an adjacent, identical segment to allow insertion of an arcuate connecting member, said arcuate channel opening at its other end into a recess in the internal surface of the segment through which the connecting member can be inserted into the channel.

8. An annulus for a tunnel lining, comprising a plurality of concrete segments according to claim 1 which are joined end-to-end.

9. An annulus according to claim 8, including a key segment positioned between and abutting a pair of segments adjacent thereto, the key segment being provided with channel portions registerable at either end with channel portions at the abutting ends of the adjacent segments to form channels disposed at an angle to one another so that the assembly of the segment and the two adjacent segments can be held together by insertion of connecting dowels into the channels.

10. An annulus according to claim 9, in which the channel portions of the key segment open into one of the sides thereof.

11. An annulus according to claim 9, in which the channel portions of the key segment open into the interior surface of the key segment so that dowels can be inserted in the channels from within the annulus.

12. An annulus according to claim 8, including a key segment positioned between and abutting a pair of segments adjacent thereto, the key segment being formed with radial end faces each having a circumferentially outwardly projecting apertured bar and the adjacent segments having radial end faces each formed with a slot to receive its associated bar, the adjacent segments each being formed with an axial aperture to receive a locking dowel passed therethrough and through the aperture in the corresponding bar.

13. An annulus according to claim 8, including a key segment positioned between and abutting a pair of segments adjacent thereto, the key segment having at least one lug at each end provided with a hole and the abutting ends of the adjacent segments having corresponding lugs provided with a hole aligned with the hole in the lug of the corresponding end of the key segment to receive a dowel locking the key segment to the adjacent segment.

14. An annulus according to claim 13, in which the key segment is provided with a recess opening into the interior surface of the annulus to allow mounting in place of the dowels.

15. An annulus according to 9, including an invert segment provided at both ends with blind internal channel portions to register with channel portions in segments adjacent thereto to receive dowels connecting the insert segment to the segments adjacent thereto.

16. An annulus according to claim 9, provided with apertures through which grouting material may be supplied from the inside to the outside of the assembled annulus.

17. A tunnel lining, comprising a plurality of annuli according to claim 9 which are joined together at their sides.

18. A segment according to claim 1, wherein said connecting dowels are insertable from one radial side of the segment.

* * * * *